US008701455B2

(12) United States Patent
Sagara et al.

(10) Patent No.: US 8,701,455 B2
(45) Date of Patent: Apr. 22, 2014

(54) METHOD FOR MANUFACTURING A HIGH ALLOY PIPE

(75) Inventors: Masayuki Sagara, Nishinomiya (JP); Hitoshi Suwabe, Itami (JP); Hisashi Amaya, Kyoto (JP); Shigemitsu Kimura, Nishinomiya (JP); Masaaki Igarashi, Sanda (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 445 days.

(21) Appl. No.: 12/650,585

(22) Filed: Dec. 31, 2009

(65) Prior Publication Data

US 2010/0170320 A1 Jul. 8, 2010

Related U.S. Application Data

(63) Continuation of application No. PCT/JP2008/061617, filed on Jun. 26, 2008.

(30) Foreign Application Priority Data

Jul. 2, 2007 (JP) ..... 2007-173638
Jan. 21, 2008 (JP) ..... 2008-010557

(51) Int. Cl.
*B21B 19/04* (2006.01)

(52) U.S. Cl.
USPC ..... 72/97

(58) Field of Classification Search
USPC ..... 72/95, 97, 98, 256, 264, 266, 365.2
See application file for complete search history.

(56) References Cited

U.S. PATENT DOCUMENTS 4,302,247 A * 11/1981 Abe et al. ..... 148/442
4,421,571 A * 12/1983 Kudo et al. ..... 148/501
6,073,331 A * 6/2000 Katsumura et al. ..... 29/423
6,171,547 B1 * 1/2001 Sagara et al. ..... 420/49
2006/0034724 A1 * 2/2006 Hamano et al. ..... 420/39
2007/0175547 A1 * 8/2007 Igarashi et al. ..... 148/442
2008/0089803 A1 * 4/2008 Okada et al. ..... 420/38

FOREIGN PATENT DOCUMENTS

| | | | | |
|---|---|---|---|---|
| GB | 2105368 A * | 3/1983 | ..... | C22C 38/44 |
| GB | 2 117 792 | 10/1983 | | |
| JP | 58-006927 A | 1/1983 | | |
| JP | 58-006928 A | 1/1983 | | |
| JP | 58-009922 A | 1/1983 | | |
| JP | 58-011735 A | 1/1983 | | |
| JP | 58-011736 | 1/1983 | | |
| JP | 59-182956 A | 10/1984 | | |
| JP | 60-149748 A | 8/1985 | | |
| JP | 63-083248 A | 4/1988 | | |
| JP | 63-203722 | 8/1988 | | |
| JP | 63-274743 A | 11/1988 | | |
| JP | 03-297505 A | 12/1991 | | |
| JP | 11-302801 A | 11/1999 | | |
| WO | 01/90432 | 11/2001 | | |
| WO | 03/044239 | 5/2003 | | |
| WO | 2006/003953 A1 | 1/2006 | | |

* cited by examiner

*Primary Examiner* — Shelley Self
*Assistant Examiner* — Lawrence Averick
(74) *Attorney, Agent, or Firm* — Clark & Brody

(57) ABSTRACT

A method for manufacturing a high alloy pipe comprises hot working, a high alloy material pipe having controlled amounts of C, Si, Mn, P, S, Ni, Cr, Mo, Cu, Al, N, O, and optionally Ca, Mg, and rare earth elements, with the balance Fe. The pipe composition satisfies the formula $N \times O \leq 0.001$. The pipe is subjected to cold working to form the high alloy pipe, wherein the final cold working process is performed under the condition that a working ratio Rd in the reduction of area satisfies $15 \leq Rd\ (\%) \leq 370 \times (C+N)$, where N, O and C are the contents (by mass percent) of the respective elements, and Rd is the working ratio (%) in the reduction of area. The pipe has an excellent ductility and an excellent corrosion resistance when cold working is performed to obtain a high strength after pipe-making.

2 Claims, No Drawings

METHOD FOR MANUFACTURING A HIGH ALLOY PIPE

This application is a continuation of International Patent Application No. PCT/JP2008/061617, filed Jun. 26, 2008. This PCT application was not in English as published under PCT Article 21(2).

TECHNICAL FIELD

The present invention relates to a method for manufacturing a high alloy pipe or tube (hereinafter, referred simply to as "pipe") excellent in normal-temperature ductility. More particularly, it relates to a method for manufacturing a high alloy pipe which can be hot worked for pipe-making, and which has a sufficient ductility when cold working is further performed to obtain a higher strength after pipe-making.

BACKGROUND ART

For oil wells and gas wells (hereinafter, referred simply to as "oil wells") in a deep or severe corrosive environment, high alloy pipes made from a high Cr-high Ni alloy have been used as oil well pipes. For the purpose of use in an environment that is severer than the conventional environment, a high-strength high alloy pipe having a strength especially of as high as 110 to 140 ksi grade (minimum yield strength: 757.3 to 963.8 MPa) and also having corrosion resistance has been demanded. In the case where the high-strength high alloy pipe is used as an oil well pipe in an environment in which a bending force or a tensile force is applied, both of strength and high ductility have been required because buckling, breakage, and the like may occur. For example, ISO 13680 "Petroleum and natural gas industries—Corrosion-resistant alloy seamless tubes for use as casing, tubing and coupling stock—Technical delivery conditions" specifies that elongations at the yield strengths of 110 ksi grade (757.3 MPa), 125 ksi grade (860.5 MPa), and 140 ksi grade (963.8 MPa) should be 11% or higher, 10% or higher, and 9% or higher, respectively. Thus, for the purpose of use in a severer environment, a high alloy pipe having a further high elongation has been demanded.

Furthermore, from the viewpoint of manufacture, the high alloy pipe is manufactured from a high alloy billet in hot working processes by extrusion pipe making processes including the Ugine-Sejournet process, the Mannesmann pipe making process, or the like. Excellent hot workability is also required in such processes.

Patent Documents 1 and 2 disclose an austenitic stainless steel in which, in order to prevent intergranular cracking from occurring when a high alloy steel cast piece manufactured by continuous casting is hot rolled, the hot workability is improved by controlling the S content and the O content to a range defined by an expression in relation to the Ca content and the Ce content. However, no material design in which the improvement is taken into consideration of ductility at the time when the high Cr-high Ni alloy is subjected to the final cold working process to strengthen the alloy has been studied.

On the other hand, Patent Documents 3 to 6 disclose a method for obtaining a high-strength high alloy oil well pipe by subjecting a high Cr-high Ni alloy to hot working and solution treatment and then to cold working at a wall thickness reduction ratio of 10 to 60%.

Furthermore, Patent Document 7 discloses an austenitic alloy excellent in corrosion resistance in a hydrogen sulfide environment, which is cold worked by controlling the shapes of inclusions with La, Al, Ca and O contained in a specific relation. The cold working in this invention is performed to give strength; from the viewpoint of corrosion resistance, the wall thickness reduction ratio is defined as 30% or less.

Also, Patent Document 8 discloses a high Cr-high Ni alloy in which the contents of Cu and Mo are adjusted to improve the SCC resistance in a hydrogen sulfide environment, and describes that it is preferable that the strength be controlled by further performing cold working at a working ratio of 30% or less after hot working.

Patent Document 1: JP59-182956A
Patent Document 2: JP60-149748A
Patent Document 3: JP58-6927A
Patent Document 4: JP58-9922A
Patent Document 5: JP58-11735A
Patent Document 6: U.S. Pat. No. 4,421,571A
Patent Document 7: JP63-274743A
Patent Document 8: JP11-302801A

DISCLOSURE OF THE INVENTION

Problems to be Solved by the Invention

Unfortunately, since the ductility of high-strength material decreases naturally, in the case where the high-strength material is used in an environment in which a bending force or a tensile force is applied like an oil well pipe, buckling, breakage, and the like may occur. However, all of the aforementioned Patent Documents do not suggest the improvement in ductility.

The present invention has been made in view of the above circumstances, and accordingly an object thereof is to provide a method for manufacturing a high alloy pipe which can be hot worked for pipe-making, and which has a sufficient ductility and excellent corrosion resistance even after cold working for obtaining a higher strength after pipe-making.

Means for Solving the Problems

To solve the above-described problem, the present inventors conducted various studies and experiments on the hot workability and the ductility after cold working, and resultantly obtained findings of the following items (a) to (e):

(a) A high alloy pipe used for an oil well in a deep or severe corrosive environment is required to have corrosion resistance. When the basic chemical composition of the high alloy pipe is 20 to 30% of Cr, 22 to 40% of Ni, and 0.01 to 4% of Mo, the C content must be reduced from the viewpoint of corrosion resistance.

(b) If the C content is reduced, the strength may possibly fall short without further treatment. Therefore, it is preferable that N be contained higher to improve the strength by solid-solution strengthening due to N.

(c) If the N content is increased, the hot workability may possibly be deteriorated, and a flaw developed when the pipe is hot worked for pipe-making may possibly lead to a flaw of the product. However, it was found that the pipe can be hot worked for pipe-making by regulating the product of the N content and the O content so as to be not larger than a predetermined value as shown in formula (1):

$$N \times O \leq 0.001 \quad (1)$$

where N and O are the contents (by mass percent) of the respective elements.

The upper limit of the product of the N content and the O content is preferably 0.0007, more preferably 0.0005.

(d) A high alloy material pipe formed by hot working is to be further strengthened by the subsequent cold working, and a high N material can provide a high strength for the material pipe subjected to solution heat treatment. Therefore, after the high alloy material pipe has been formed, a desired strength can be secured even at a low working ratio (reduction of area) without excessively increasing the working ratio at the time of cold working. Thus, by using a high N material, a decrease in normal-temperature ductility (elongation in tensile test) caused by high working ratio can be avoided.

(e) To obtain a high alloy pipe having high normal-temperature ductility, based on the above-described findings, the present inventors closely investigated the relationship between the working ratio and the N content in the final cold working process after the solution heat treatment. As a result, it was revealed that the alloy component and the working ratio exert an influence on the strength and the normal-temperature ductility (elongation), and as the content of specific alloying elements are increased, or as the cold working ratio is increased, the normal-temperature ductility is decreased though the strength is increased. Therefore, it was found that in order to obtain a high alloy pipe securing the targeted high strength and high normal-temperature ductility (elongation), the N content should be regulated so as to be higher than 0.05% and not higher than 0.30%, and also, paying attention to the (C+N) amount, which is the sum of the C content and the N content, and the working ratio that exert a great influence on the strength, the working ratio Rd (%) in the reduction of area should be held to 370×(C+N) or less.

Also, it was found that, for obtaining the target strength, the working ratio Rd (%) in the reduction of area must be 15 or higher.

That is to say, it was found that a high alloy pipe having high strength and high normal-temperature ductility can be obtained by performing cold working at the working ratio expressed by formula (2):

$$15 \leq Rd(\%) \leq 370 \times (C+N) \quad (2)$$

where C and N are the contents (by mass percent) of the respective elements, and Rd is the working ratio (%) in the reduction of area.

The preferable upper limit of Rd (%) is 325×(C+N), the more preferable upper limit thereof being 280×(C+N).

The present invention has been completed on the basis of the above-described new findings, and the gists thereof are as given in the following items (1) and (2). Hereunder, these gists are called the present invention (1) and the present invention (2). The present invention (1) and the present invention (2) are sometimes generically called the present invention.

(1) A method for manufacturing a high alloy pipe, characterized by comprising forming, by hot working, a high alloy material pipe which has a chemical composition that consists of, by mass percent, C: 0.03% or less, Si: 1.0% or less, Mn: 0.05 to 1.5%, P: 0.03% or less, S: 0.03% or less, Ni: more than 22% and not more than 40%, Cr: 20 to 30%, Mo: not less than 0.01% and less than 4.0%, Cu: 0 to 4.0%, Al: 0.001 to 0.30%, N: more than 0.05% and not more than 0.30%, and O: 0.010% or less, the balance being Fe and impurities, and that satisfies formula (1) for the product of the N content and the O content, and thereafter performing cold working to form the high alloy pipe, wherein the final cold working process is performed under the condition that a working ratio Rd in the reduction of area satisfies formula (2):

$$N \times O \leq 0.001 \leq \quad (1)$$

$$15 \leq Rd(\%) \leq 370 \times (C+N) \quad (2)$$

where N, O and C are the contents (by mass percent) of the respective elements, and Rd is the working ratio (%) in the reduction of area.

(2) The method for manufacturing a high alloy pipe according to the item (1) above, characterized by that the high alloy material pipe has a chemical composition that contains, by mass percent, one or more kinds of Ca: 0.01% or less, Mg: 0.01% or less, and rare-earth elements: 0.2% or less, in place of part of Fe.

Advantages of the Invention

According to the present invention, there can be provided a method for manufacturing a high alloy pipe which can be hot worked for pipe-making and has an excellent ductility and an excellent corrosion resistance even after cold working for obtaining a high strength after pipe-making.

BEST MODE FOR CARRYING OUT THE INVENTION

Next, the reasons for restricting the chemical composition of a high alloy steel used in the method for manufacturing a high alloy pipe according to the present invention is described. The term "%" of the content of each element denotes "mass percent".

C: 0.03% or Less

C (carbon) forms Cr carbides in the crystal grain boundaries if the content thereof exceeds 0.03%, which results in an increased susceptibility to stress corrosion cracking at the grain boundary. Therefore, the upper limit of the C content is defined as 0.03%. The preferable upper limit thereof is 0.02%.

Si: 1.0% or Less

Si (silicon) is an element effective as a deoxidizer for an alloy, and may be contained if necessary. However, if the Si content exceeds 1.0%, the hot workability is deteriorated; therefore, the Si content is defined as 1.0% or less. The preferable Si content is 0.5% or less.

Mn: 0.05 to 1.5%

Mn (manganese) is, like Si, an element effective as a deoxidizer for an alloy, and this effect can be achieved by a content of 0.05% or higher. However, if the Mn content exceeds 1.5%, the hot workability is deteriorated. Therefore, the Mn content is defined as 0.05 to 1.5%. The preferable range thereof is 0.5 to 0.75%.

P: 0.03% or Less

P (phosphorus) is contained as an impurity, and if the content thereof exceeds 0.03%, the susceptibility to stress corrosion cracking in a hydrogen sulfide environment increases. Therefore, the upper limit of the P content is defined as 0.03% or less. The preferable upper limit thereof is 0.025%.

S: 0.03% or Less

S (sulfur) is, like P, contained as an impurity, and if the content thereof exceeds 0.03%, the hot workability is deteriorated remarkably. Therefore, the upper limit of the S content is defined as 0.03%. The preferable upper limit thereof is 0.005%.

Ni: More than 22% and not More than 40%

Ni (nickel) has a function of improving the hydrogen sulfide corrosion resistance. However, if the Ni content is 22% or less, a Ni sulfide film formed on the outer surface of alloy is insufficient, so the effect of Ni component cannot be achieved. On the other hand, even if more than 40% of Ni is contained, the effect saturates, and the alloy cost increases, reducing the economical efficiency. Therefore, the Ni content is defined as more than 22% and not more than 40%. The preferable range thereof is 25 to 37%, more preferably being not less than 27% and less than 35%.

Cr: 20 to 30%

Cr (chromium) is a component effective in improving hydrogen sulfide corrosion resistance represented by stress corrosion cracking resistance under coexistence with Ni. However, if the Cr content is less than 20%, this effect cannot be achieved. On the other hand, if the Cr content exceeds 30%, the effect saturates, which is undesirable from the viewpoint of hot workability. Therefore, the Cr content is defined as 20 to 30%. The preferable range thereof is 22 to 28%.

Mo: Not Less than 0.01% and Less than 4.0%

Mo (molybdenum) has a function of improving the stress corrosion cracking resistance under coexistence with Ni and Cr. However, if the Mo content is less than 0.01%, this effect is insufficient. On the other hand, if the Mo content is 4.0% or more, the effect saturates, and the excessive content deteriorates the hot workability. Therefore, the Mo content is defined as not less than 0.01% and less than 4.0%. The preferable range thereof is not less than 0.05% and less than 3.4%, the more preferable range thereof being 0.1 to 3.0%. In order to obtain better stress corrosion cracking resistance, the lower limit of the Mo content is preferably 1.5%. The more preferable lower limit thereof is 2.0%.

Cu: 0 to 4.0% (Including No Addition)

Cu (copper) has a function of remarkably improving the hydrogen sulfide corrosion resistance in a hydrogen sulfide environment, and may be contained if necessary. When it is desired to achieve this effect, 0.1% or more of Cu is preferably contained. However, if the Cu content exceeds 4.0%, the effect saturates, and the hot workability is inversely deteriorated. Therefore, in the case where Cu is contained, the upper limit of the Cu content is defined as 4.0%. The range of the Cu content is preferably 0.2 to 3.5%. The more preferable range thereof is 0.5 to 2.0%.

Al: 0.001 to 0.30%

Al (aluminum) is an element effective as a deoxidizer for an alloy. To prevent Si or Mn from fowling the oxide of Si or Mn, which are harmful to hot workability, 0.001% or more of Al is necessary for fixing oxygen. However, if the Al content exceeds 0.30%, the hot workability is deteriorated. Therefore, the Al content is defined as 0.001 to 0.30%. The preferable range thereof is 0.01 to 0.20%. The range of 0.01 to 0.10% is more preferable.

N: More than 0.05% and not More than 0.30%

N (nitrogen) is an important element in the present invention. For the high alloy of the present invention, the C content must be reduced from the viewpoint of corrosion resistance. Therefore, N is contained positively to attain high strength by solid-solution strengthening without deteriorating the corrosion resistance. In addition, a material pipe subjected to solution heat treatment can provide high strength by a high N content. Therefore, a desired strength can be secured even at a low working ratio (reduction of area) without excessively increasing the working ratio at the time when cold working is further performed, so that a decrease in ductility due to high working ratio can be restrained. To achieve this effect, more than 0.05% of N must be contained. On the other hand, if the N content exceeds 0.30%, the hot workability is deteriorated. Therefore, the N content is defined as more than 0.05% and not more than 0.30%. The preferable range thereof is 0.06 to 0.22%.

O: 0.010% or Less

O (oxygen) is contained as an impurity, and if the O content exceeds 0.010%, the hot workability is deteriorated. Therefore, the O content is defined as 0.010 or less.

N×O: 0.001 or Less

In the present invention, since N is contained in large amounts so that the N content is more than 0.05% and not more than 0.30%, the hot workability is easily deteriorated. Therefore, the product of the N content (%) and the O content (%) must be made 0.001% or less.

The high alloy steel according to the present invention may further contain one or more kinds of Ca, Mg, and rare-earth elements (REM) in addition to the above-described alloying elements. The reason why these elements are allowed to be contained and the contents of these elements to be added are as described below.

One or More Kinds of Ca: 0.01% or Less, Mg: 0.01% or Less, and Rare-Earth Elements: 0.2% or Less These components may be contained if necessary. If any of these components are contained, an effect of improving the hot workability is achieved. However, if the content of either of Ca and Mg exceeds 0.01%, or if the content of any of REM exceeds 0.2%, coarse oxides are produced, and the hot workability is instead deteriorated. Therefore, if these elements are contained, the upper limits of the Ca content and the Mg content are defined as 0.01%, and the upper limit of the REM content is defined as 0.2%. In order to surely achieve the effect of improving the hot workability, 0.0005% or more of Ca and Mg, and 0.001% or more of REM are preferably contained. The REM is a general term of 17 elements including 15 lanthanoid elements and Y and Sc.

The high alloy pipe according to the present invention, which contains the above-described essential elements or further the optional elements, the balance being Fe and impurities, can be manufactured by using the manufacturing equipment and the manufacturing method that are usually used for commercial production. For example, for the melting of alloy, an electric furnace, an Ar—$O_2$ mixed gas bottom-blown decarburization furnace (AOD furnace), a vacuum decarburization furnace (VOD furnace), or the like can be used. The obtained molten metal may be cast into an ingot, or may be cast into a rod-shaped billet etc. by the continuous casting process. By using the billet, the high alloy pipe can be manufactured in hot working processes by extrusion pipe making processes including the Ugine-Sejournet process, the Mannesmann pipe making process, or the like. The hot worked pipe can be turned into a product pipe having a desired strength by cold working, such as cold rolling or cold drawing, performed after solution heat treatment.

EXAMPLE 1

The alloys having the chemical composition given in Table 1 were melted in an electric furnace, and the component adjustment was made so as to attain the target chemical composition; thereafter, the alloys were melted by a method in which decarburization treatment and desulfurization treatment are performed by using an AOD furnace. The obtained molten metal was cast into an ingot having a weight of 1500 kg and a diameter of 500 mm.

TABLE 1

| Test | Chemical composiiton (mass %. the balance being Fe and impurities) | | | | | | | | | | | | |
|---|---|---|---|---|---|---|---|---|---|---|---|---|---|
| No. | C | Si | Mn | P | S | Ni | Cr | Mo | Cu | Al | N | O | Ca |
| 1 | 0.020 | 0.23 | 0.59 | 0.020 | 0.0003 | 30.15 | 24.51 | 2.77 | 0.77 | 0.036 | 0.0797 | 0.0050 | 0.0020 |
| 2 | 0.020 | 0.31 | 0.59 | 0.021 | 0.0002 | 30.13 | 24.71 | 2.77 | 0.80 | 0.037 | 0.0828 | 0.0050 | 0.0018 |
| 3 | 0.020 | 0.24 | 0.59 | 0.021 | 0.0003 | 30.16 | 24.77 | 2.78 | 0.81 | 0.037 | 0.0797 | 0.0050 | 0.0019 |
| 4 | 0.020 | 0.32 | 0.61 | 0.020 | 0.0002 | 30.35 | 24.84 | 2.83 | 0.74 | 0.033 | 0.0820 | 0.0050 | 0.0016 |
| 5 | 0.020 | 0.19 | 0.61 | 0.021 | 0.0004 | 30.10 | 24.56 | 2.77 | 0.78 | 0.036 | 0.0835 | 0.0050 | 0.0017 |
| 6 | 0.019 | 0.32 | 0.60 | 0.022 | 0.0002 | 30.06 | 24.57 | 2.75 | 0.81 | 0.038 | 0.0845 | 0.0050 | 0.0030 |
| 7 | 0.020 | 0.24 | 0.59 | 0.023 | 0.0003 | 30.33 | 24.72 | 2.76 | 0.76 | 0.034 | 0.0803 | 0.0048 | 0.0032 |
| 8 | 0.018 | 0.30 | 0.59 | 0.021 | 0.0003 | 30.17 | 24.71 | 2.79 | 0.81 | 0.037 | 0.0849 | 0.0045 | 0.0022 |
| 9 | 0.020 | 0.23 | 0.59 | 0.020 | 0.0003 | 30.15 | 24.51 | 2.77 | 0.77 | 0.036 | 0.0797 | 0.0041 | 0.0020 |
| 10 | 0.019 | 0.30 | 0.59 | 0.023 | 0.0003 | 30.15 | 24.52 | 2.77 | 0.77 | 0.036 | 0.0789 | 0.0038 | 0.0032 |
| 11 | 0.019 | 0.23 | 0.58 | 0.021 | 0.0003 | 30.13 | 24.51 | 2.77 | 0.78 | 0.031 | 0.0801 | 0.0037 | 0.0015 |
| 12 | 0.021 | 0.26 | 0.59 | 0.021 | 0.0004 | 30.31 | 24.83 | 2.79 | 0.77 | 0.030 | 0.0871 | 0.0042 | 0.0019 |
| 13 | 0.018 | 0.25 | 0.60 | 0.021 | 0.0003 | 30.15 | 24.92 | 2.86 | — | 0.042 | 0.0798 | 0.0035 | 0.0020 |
| 14 | 0.019 | 0.23 | 0.59 | 0.020 | 0.0005 | 30.55 | 24.81 | 2.89 | 0.82 | 0.040 | 0.0827 | 0.0041 | 0.0017 |
| 15 | 0.020 | 0.24 | 0.58 | 0.021 | 0.0005 | 30.41 | 24.93 | 2.84 | 0.82 | 0.041 | 0.0790 | 0.0044 | 0.0022 |
| 16 | 0.020 | 0.29 | 0.58 | 0.019 | 0.0002 | 30.26 | 24.69 | 2.75 | 0.72 | 0.037 | 0.0827 | 0.0038 | 0.0020 |
| 17 | 0.018 | 0.21 | 0.59 | 0.023 | 0.0005 | 30.26 | 24.79 | 2.84 | 0.80 | 0.033 | 0.0802 | 0.0049 | — |
| 18 | 0.019 | 0.29 | 0.59 | 0.006 | 0.0007 | 25.18 | 24.87 | 0.37 | 2.96 | 0.09 | 0.0838 | 0.0025 | 0.0011 |
| 19 | 0.019 | 0.28 | 0.58 | 0.006 | 0.0004 | 24.80 | 24.51 | 0.32 | 2.84 | 0.08 | 0.0799 | 0.0023 | 0.0012 |
| 20 | 0.021 | 0.19 | 0.58 | 0.021 | 0.0002 | 30.29 | 24.87 | 2.78 | 0.78 | 0.040 | 0.0808 | 0.0048 | 0.0017 |
| 21 | 0.022 | 0.24 | 0.60 | 0.020 | 0.0002 | 30.27 | 24.82 | 2.76 | 0.76 | 0.042 | 0.0794 | 0.0042 | 0.0020 |
| 22 | 0.018 | 0.23 | 0.59 | 0.022 | 0.0005 | 30.37 | 24.94 | 2.86 | 0.80 | 0.039 | 0.0850 | 0.0049 | 0.0022 |
| 23 | 0.020 | 0.22 | 0.58 | 0.021 | 0.0005 | 30.49 | 24.67 | 2.87 | 0.76 | 0.044 | 0.0817 | 0.0043 | 0.0017 |
| 24 | 0.019 | 0.22 | 0.60 | 0.021 | 0.0003 | 30.23 | 24.68 | 2.83 | 0.77 | 0.033 | 0.0856 | 0.0032 | 0.0019 |
| 25 | 0.021 | 0.19 | 0.58 | 0.021 | 0.0002 | 30.29 | 24.87 | 2.78 | 0.78 | 0.040 | 0.0808 | 0.0036 | 0.0017 |
| 26 | 0.012 | 0.24 | 0.57 | 0.023 | 0.0002 | 30.71 | 25.26 | 2.83 | 0.78 | 0.132 | 0.1960 | 0.0031 | 0.0027 |
| 27 | 0.019 | 0.25 | 0.57 | 0.023 | 0.0004 | 30.16 | 24.88 | 2.87 | 0.79 | 0.041 | 0.0810 | 0.0047 | 0.0023 |
| 28 | 0.020 | 0.26 | 0.58 | 0.020 | 0.0003 | 30.25 | 24.67 | 2.84 | 0.80 | 0.037 | 0.0540 | 0.0043 | 0.0026 |
| 29 | 0.020 | 0.25 | 0.60 | 0.021 | 0.0004 | 30.35 | 25.13 | 2.81 | 0.80 | 0.039 | 0.1330 | 0.0150 | 0.0012 |

| Test No. | 370 × (C + N) | N × O | Rd (%) | YS (MPa) | TS (MPa) | EL | Reduction of area (%) | Grade | |
|---|---|---|---|---|---|---|---|---|---|
| 1 | 36.9 | 0.00040 | 21.7 | 794.3 | 858.0 | 23.4 | 73 | 110 ksi | The present invention |
| 2 | 38.0 | 0.00041 | 23.4 | 825.7 | 886.5 | 22.9 | 70 | | |
| 3 | 36.9 | 0.00040 | 23.4 | 829.6 | 884.5 | 22.4 | 68 | | |
| 4 | 37.7 | 0.00041 | 23.4 | 843.3 | 893.3 | 22.0 | 69 | | |
| 5 | 38.3 | 0.00042 | 23.4 | 840.4 | 897.2 | 21.1 | 69 | | |
| 6 | 38.3 | 0.00042 | 23.4 | 845.3 | 891.4 | 21.1 | 80 | | |
| 7 | 37.1 | 0.00039 | 23.4 | 849.2 | 897.2 | 20.3 | 79 | | |
| 8 | 38.1 | 0.00038 | 23.1 | 811.9 | 863.9 | 25.3 | 72 | | |
| 9 | 36.9 | 0.00033 | 23.1 | 803.1 | 856.1 | 25.5 | 68 | | |
| 10 | 36.2 | 0.00030 | 23.1 | 824.7 | 874.7 | 23.9 | 79 | | |
| 11 | 36.7 | 0.00030 | 23.1 | 831.5 | 881.6 | 23.4 | 71 | | |
| 12 | 40.0 | 0.00037 | 23.1 | 839.4 | 883.5 | 24.0 | 74 | | |
| 13 | 36.2 | 0.00028 | 23.1 | 826.6 | 877.6 | 25.5 | 79 | | |
| 14 | 37.6 | 0.00034 | 21.9 | 840.4 | 880.6 | 18.0 | 71 | | |
| 15 | 36.6 | 0.00035 | 21.9 | 841.4 | 870.8 | 18.2 | 75 | | |
| 16 | 38.0 | 0.00031 | 21.9 | 833.5 | 868.8 | 18.6 | 72 | | |
| 17 | 36.3 | 0.00039 | 21.9 | 847.2 | 892.3 | 17.4 | 66 | | |
| 18 | 38.0 | 0.00021 | 23.4 | 783.2 | 830.7 | 21.0 | 66 | | |
| 19 | 36.6 | 0.00018 | 28.3 | 823.2 | 861.8 | 20.1 | 65 | | |
| 20 | 37.7 | 0.00039 | 32.5 | 884.5 | 945.3 | 16.8 | 73 | 125 ksi | |
| 21 | 37.5 | 0.00033 | 32.5 | 906.1 | 958.0 | 16.3 | 71 | | |
| 22 | 38.1 | 0.00042 | 32.5 | 876.7 | 950.2 | 16.3 | 70 | | |
| 23 | 37.6 | 0.00035 | 32.5 | 918.8 | 971.8 | 14.8 | 69 | | |
| 24 | 38.7 | 0.00027 | 32.5 | 884.5 | 962.0 | 16.7 | 75 | | |
| 25 | 37.7 | 0.00029 | 32.5 | 902.2 | 954.1 | 16.0 | 74 | | |
| 26 | 77.0 | 0.00061 | 28.0 | 1025.4 | 1075.7 | 20.5 | 65 | 140 ksi | |
| 27 | 37.0 | 0.00038 | 40.0 | 1032.6 | 1083.6 | 8.0 | 70 | — | C* |
| 28 | 27.4 | 0.00023 | 28.0 | 803.3 | 856.1 | 11.0 | 80 | — | |
| 29 | 56.6 | 0.00200 | 21.7 | 956.9 | 1008.1 | 19.0 | 30 | — | |

C*: The comparative

The ingots having the chemical composition given in Table 1 were subjected to the treatment described below. First, the ingots were heated to 1250° C., and each were formed into a rod shape having a diameter of 150 mm by hot forging at 1200° C.

To evaluate the hot workability from this formed material, a round bar shaped specimen having a parallel-part diameter of 10 mm and a parallel-part length of 100 mm was sampled in conformity to JIS G0567. The specimen was heated to 900° C., and was held for 10 minutes; thereafter, a high-temperature tensile test was conducted at a strain rate of 0.3%/min to determine the reduction of area. The results are also shown in Table 1.

Furthermore, the formed material was cut to a length of 1000 mm to obtain a billet for extrusion pipe making. Next, by using this billet, a material pipe for cold working was formed by the extrusion pipe making process using the Ugine-Sejournet process.

After softening heat treatment, the obtained material pipe for cold working was drawn once or a plurality of times during cold drawing work, and thereafter subjected to solution heat treatment under a condition of being held at 1100° C. for 0.5 hour and water cooled. Subsequently, the final cold working was performed by a drawing method using a plug and a die to obtain a high alloy pipe having the target pipe strength level.

Table 2 gives the dimensions before and after final cold working, the cold working ratio (reduction of area), and the target pipe strength level (minimum yield strength) of each test number.

TABLE 2

| Test No. | Dimension before final cold woking (Outer diameter × wall thickness) (mm) | Dimension after final cold woking (Outer diameter × wall thickness) (mm) | Cold working ratio in reduction of area Rd (%) | Target pipe strength level (Minimum yield strength) | |
|---|---|---|---|---|---|
| 1 | 194.0 × 10.85 | 178.5 × 9.19 | 21.7 | 757.3 MPa(110 ksi) | The present invention |
| 2-7 | 194.0 × 11.10 | 178.5 × 9.19 | 23.4 | ibid. | |
| 8-13 | 194.0 × 12.48 | 178.5 × 10.36 | 23.1 | ibid. | |
| 14-17 | 97.0 × 7.66 | 89.3 × 6.45 | 21.9 | ibid. | |
| 18 | 194.0 × 11.00 | 178.5 × 9.10 | 23.4 | ibid. | |
| 19 | 194.0 × 11.80 | 178.5 × 9.10 | 28.3 | ibid. | |
| 20-25 | 85.0 × 10.08 | 73.0 × 7.82 | 32.5 | 860.5 MPa(125 ksi) | |
| 26 | 194.0 × 11.87 | 178.5 × 9.19 | 28.0 | 963.8 MPa(140 ksi) | |
| 27 | 97.0 × 10.26 | 89.3 × 6.45 | 40.0 | 963.8 MPa(140 ksi) | C* |
| 28 | 85.0 × 9.36 | 73.0 × 7.82 | 28.0 | 757.3 MPa(110 ksi) | |
| 29 | 194.0 × 10.85 | 178.5 × 9.19 | 21.7 | 963.8 MPa(140 ksi) | |

C*: The comparative

A tensile test was conducted by sampling an arc-shaped tensile specimen from the obtained high alloy pipe to determine yield strength (0.2% yield stress) YS, tensile strength TS, and elongation El. The results thereof are also shown in Table 1.

The pipes of test Nos. 1 to 26 in according to the present invention have the target pipe strength level, and also have elongation sufficiently higher than the minimum elongation value specified in ISO. Further, the reduction of area in the high-temperature tensile test has a sufficiently high value, and the hot workability is also good.

On the other hand, the pipes of test Nos. 27 and 28 pertaining to the comparative do not satisfy formula (2), so the elongation is insufficient although the strength is high. Also, the pipe of test No. 29 pertaining to the comparative does not satisfy formula (1), so the hot workability is bad.

INDUSTRIAL APPLICABILITY

According to the present invention, there can be provided a method for manufacturing a high alloy pipe which can be hot worked for pipe-making, and has an excellent ductility and excellent corrosion resistance when cold working is further performed to obtain a high strength after pipe-making.

The invention claimed is:

1. A method for manufacturing a high alloy pipe, characterized by comprising forming, by hot working, a high alloy material pipe which has a chemical composition that consists of, by mass percent, C: 0.03% or less, Si: 1.0% or less, Mn: 0.05 to 1.5%, P: 0.03% or less, S: 0.03% or less, Ni: more than 22% and less than 35%, Cr: 20 to 30%, Mo: not less than 0.01% and less than 4.0%, Cu: 0.1 to 4.0%, Al: 0.001 to 0.30%, N: 0.06 to 0.30%, and O: 0.010% or less, the balance being Fe and impurities, and that satisfies formula (1) for the product of the N content and the O content, and thereafter performing cold working to form the high alloy pipe, wherein the final cold working process is performed under a condition that a working ratio Rd in the reduction of area satisfies formula (2):

$$N \times O \leq 0.001 \quad (1)$$

$$15 \leq Rd(\%) \leq 370 \times (C+N) \quad (2)$$

where N, O and C are the contents (by mass percent) of the respective elements, and Rd is the working ratio (%) in the reduction of area.

2. The method for manufacturing a high alloy pipe according to claim 1, characterized in that the high alloy material pipe has a chemical composition that contains, by mass percent, one or more kinds of Ca: 0.01% or less, Mg: 0.01% or less, and rare-earth elements: 0.2% or less, in place of a part of Fe.

* * * * *